US006371400B1

(12) United States Patent
Morimoto et al.

(10) Patent No.: US 6,371,400 B1
(45) Date of Patent: Apr. 16, 2002

(54) BAND STEEL PLATE WINDING APPARATUS

(75) Inventors: Kazuo Morimoto; Kazutoshi Yokoo; Kanehisa Miyaguchi, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 14 days.

(21) Appl. No.: 09/584,119

(22) Filed: May 31, 2000

(51) Int. Cl.[7] ..... B65H 18/08; B65H 19/28
(52) U.S. Cl. ..... 242/532.2; 242/534
(58) Field of Search ..... 242/532.2, 532.7, 242/534, 542.3

(56) References Cited

FOREIGN PATENT DOCUMENTS

| | | | | |
|---|---|---|---|---|
| DE | 3708891 C | | 11/1987 | |
| GB | 867086 | | 5/1961 | |
| JP | 58-9720 | * | 1/1983 | ..... 242/532.2 |
| JP | 58-215220 A | | 12/1983 | |
| JP | 8-192223 A | | 7/1996 | |

* cited by examiner

*Primary Examiner*—John M. Jillions

(57) ABSTRACT

A band steel plate winding apparatus comprises a winding drum for winding a band steel plate; unit rolls, and curved surface guides adjacent to the unit rolls, provided along a circumferential surface of the winding drum forwardly and backwardly movably between a winding drum surrounding position and a retreat position, the position of the unit roll relative to the winding drum at the time of entry of the band steel plate being downstream at an angle of about 15 degrees or less from the position of contact between the winding drum and the band steel plate; and ejection nozzles provided in a guide surface of each of the curved surface guides for ejecting a gaseous or liquid fluid at a high speed toward the band steel plate before the band steel plate collides with the curved surface guide. The band steel plate winding apparatus permits high speed winding of a band steel plate while effectively preventing buckling of a front end of the band steel plate, and can avoid a great increase in equipment cost.

7 Claims, 8 Drawing Sheets

BAND STEEL PLATE WINDING APPARATUS

BACKGROUND OF THE INVENTION

1. Field of the Invention

The present invention relates to a band steel plate winding apparatus for us in a rolling equipment for a hot rolled band steel plate or the like. More specifically, the invention relates to a winding apparatus for winding a band steel plate having a thickness of, for example, 1.6 mm or less at a high speed of, for example, 800 m/min or more.

2. Description of the Related Art

A conventional band steel plate winding device of this type is shown, for example, in FIG. 8. This device is a winding device for a band steel plate, generally called a downcoiler. As shown in FIG. 8, a plurality of roller tables 1 are disposed with a predetermined spacing on a rolling equipment line, and a pinch roll (or a deflector roll) 2 is disposed near a delivery side of each roller table 1. A band plate 3 of a steel product (hereinafter, referred to as a band steel plate) that has been rolled is guided to winding drums (mandrels) 4 of a plurality of winders disposed with a predetermined spacing below the rolling equipment line. Around each winding drum 4, a plurality of (3 in the drawing) arm-shaped frames 5*a*, 5*b*, and 5*c* are provided which are each supported at one end on a fixing base 6 via a shaft 7. Each of these frames is pivotable such that its front end is brought toward or away from the winding drum 4 from three directions. On the frames 5*a*, 5*b*, and 5*c*, unit rolls 8*a*, 8*b*, and 8*c* are supported so as to come into contact with the winding drum 4, and curved surface guides 9*a*, 9*b*, and 9*c* are attached downstream from the unit rolls 8*a*, 8*b*, and 8*c*. To these frames 5*a*, 5*b*, and 5*c*, driving cylinders 10*a*, 10*b*, and 10*c* are connected for driving the frames 5*a*, 5*b*, and 5*c* so as to be brought toward or away from a circumferential surface of the winding drum 4.

Thus, the rolled band steel plate 3 is moved from one of the pinch rolls 2 along a guide (not shown), and its front end is guided to one of the winding drums 4. Then, the rolled band steel plate 3 is lead into a space defined by the winding drum 4, the three unit rolls 8*a*, 8*b*, and 8*c*, and the three curved surface guides 9*a*, 9*b*, and 9*c*. Further, the unit rolls 8*a*, 8*b*, and 8*c* are pressed against the winding drum 4 by the driving cylinders 10*a*, 10*b*, and 10*c*, whereby the band steel plate 3 begins to be wrapped around the winding drum 4 with an adequate pressing force. After an adequate tension has become obtainable by a frictional force between the band steel plate 3 and the winding drum 4, wrapping of the band steel plate 3 around the winding drum 4 is performed, with the unit rolls 8*a*, 8*b*, and 8*c* and the curved surface guides 9*a*, 9*b*, and 9*c* being separated (moved backward) from the winding drum 4.

After a predetermined length of the band steel plate 3 is taken up, the band steel plate 3 is cut with a cutter (not shown) disposed on the rolling equipment line. A front end of the remaining band steel plate 3 is guided from the other pinch roll 2 to the other winding drum 4, and the band steel plate 3 is similarly wound. During this period, a coil of the band steel plate 3 is removed from the circumferential surface of the winding drum 4, which has finished winding, onto a carrier trolley or the like. In this manner, winding into a coil is continued.

The conventional device shown in FIG. 8 has been restricted in the speed of wrapping of the band steel plate 3 around the winding drum 4. That is, when the thickness of the band steel plate 3 is as small as 1.6 mm or less, and the rolling speed is fast, not only a radially outward force due to the flexural rigidity of the band steel plate 3 itself, but also the inertial force of the band steel plate 3, i.e., a great centrifugal force on the band steel plate 3, are exerted generally at a wrapping speed of 800 m/min or more. As a result, the band steel plate 3 is strongly pressed against the curved surface guides 9*a*, 9*b*, and 9*c* to generate high frictional resistance in the direction in which the band steel plate 3 advances. The resulting frictional force causes buckling to the band steel plate 3, whereby a front end portion of the band steel plate 3 is folded between the curved surface guides 9*a*, 9*b*, 9*c*, and the winding drum 4. Consequently, even when the winding drum 4 and the unit rolls 8*a*, 8*b*, 8*c* are rotationally driven by an electric motor powerfully, it is impossible to guide the band steel plate 3 around the winding drum 4 and wrap it around the winding drum 4.

SUMMARY OF THE INVENTION

The present invention has been conceived to solve the above-described problems with the earlier technology. It is an object of this invention to provide a band steel plate winding apparatus which permits high speed winding of a band steel plate while effectively preventing buckling of a front end of the band steel plate, and which can avoid a great increase in equipment cost.

An aspect of the present invention, for attaining the above object, is a band steel plate winding apparatus, comprising:

a winding drum for winding a band steel plate;

unit rolls, and curved surface guides adjacent to the unit rolls, provided along a circumferential surface of the winding drum forwardly and backwardly movable between a winding drum surrounding position and a retreat position; and ejection nozzles opened and formed in a guide surface of each of the curved surface guides for ejecting a gaseous or liquid fluid toward the band steel plate.

Thus, buckling stress of the band steel plate, caused by contact between the curved surface guide and the band steel plate, can be decreased, so that high speed winding can be achieved, with buckling bending of the band steel plate being prevented.

The band steel plate winding apparatus may further include:

a steel plate front end detector for detecting a front end of the band steel plate traveling on a roller table; and a controller for computing fluid ejection timing based on a front end detection signal from the steel plate front end detector and permitting the ejection nozzles to eject the fluid with appropriate timing.

Thus, the amount of the fluid used can be decreased.

The band steel plate winding apparatus may further include:

a fluid receiver provided between the ejection nozzles and a pressure generation source, whereby a pressurized fluid necessary during wrapping of the band steel plate around the winding drum can be supplied from the fluid receiver, and supply of a pressure to the fluid receiver can be performed with timing other than during wrapping of the band steel plate around the winding drum.

Thus, a pressure generator of a great capacity is not required, and an operation can be carried out using an inexpensive device.

In the band steel plate winding apparatus, a fluid supply pipe may extend over a nearly entire width of an inside chamber of each of the curved surface guides, and the fluid supply pipe may have openings in the inside chamber on a side opposite to the ejection nozzle of the guide surface.

Thus, the fluid can be ejected from the ejection nozzles almost uniformly to wrap the band steel plate smoothly around the winding drum without causing a sideways movement of the band steel plate.

Another aspect of the invention is a band steel plate winding apparatus, comprising:

a winding drum for winding a band steel plate;

unit rolls, and curved surface guides adjacent to the unit rolls, provided along a circumferential surface of the winding drum forwardly and backwardly movably between a winding drum surrounding position and a retreat position, a position of the unit roll relative to the winding drum at a time of entry of the band steel plate being downstream at an angle of about 15 degrees or less from a position of contact between the winding drum and the band steel plate; and ejection means for ejecting a gaseous or liquid fluid at a high speed toward the band steel plate from the curved surface guide before the band steel plate collides with the curved surface guide.

Thus, the band steel plate is caused to collide with the curved surface guide at a small angle of about 30 degrees or less. Because of this action coupled with a fluid ejecting action, buckling stress of the band steel plate, caused by contact between the curved surface guide and the band steel plate can be decreased, so that high speed winding, can be achieved, with buckling bending of the band steel plate being prevented.

In the above band steel plate winding apparatus, the fluid may be ejected in a direction of a center line of the winding drum, or may be ejected with a slope in a direction of advance of the band steel plate.

Thus, contact between the curved surface guide and the band steel plate can be prevented effectively.

The band steel plate winding apparatus may further include:

A steel plate front end detector for detecting a front end of the band steel plate traveling on a roller table; and a controller for computing fluid ejection timing based on a front end detection signal from the steel plate front end detector and permitting the ejection means to eject the fluid with appropriate timing.

Thus, the amount of the fluid used can be decreased.

The band steel plate winding apparatus may further include:

a fluid receiver provided between the ejection means and a pressure generation source, whereby a pressurized fluid necessary during wrapping of the band steel plate around the winding drum can be supplied from the fluid receiver, and supply of a pressure to the fluid receiver can be performed with timing other than during wrapping of the band steel plate around the winding drum.

Thus, a pressure generator of a great capacity is not required, and an operation can be carried out using an inexpensive device.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

A band steel plate winding apparatus according to the present invention will now be described in detail by way of preferred embodiments with reference to the accompanying drawings.

Figure 1:
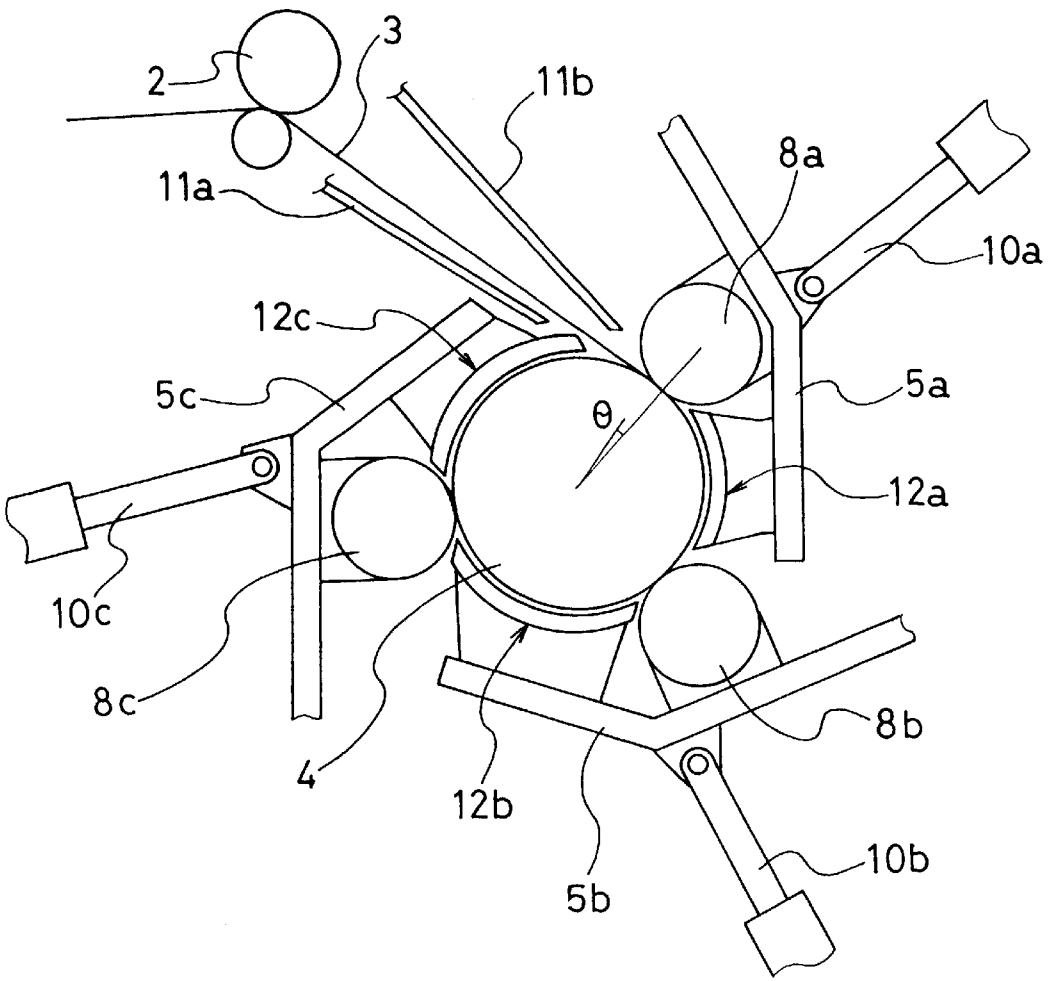
FIG. 1 is a side view of a band steel plate winding apparatus (downcoiler) showing a first embodiment of the present invention.
Figure 2:
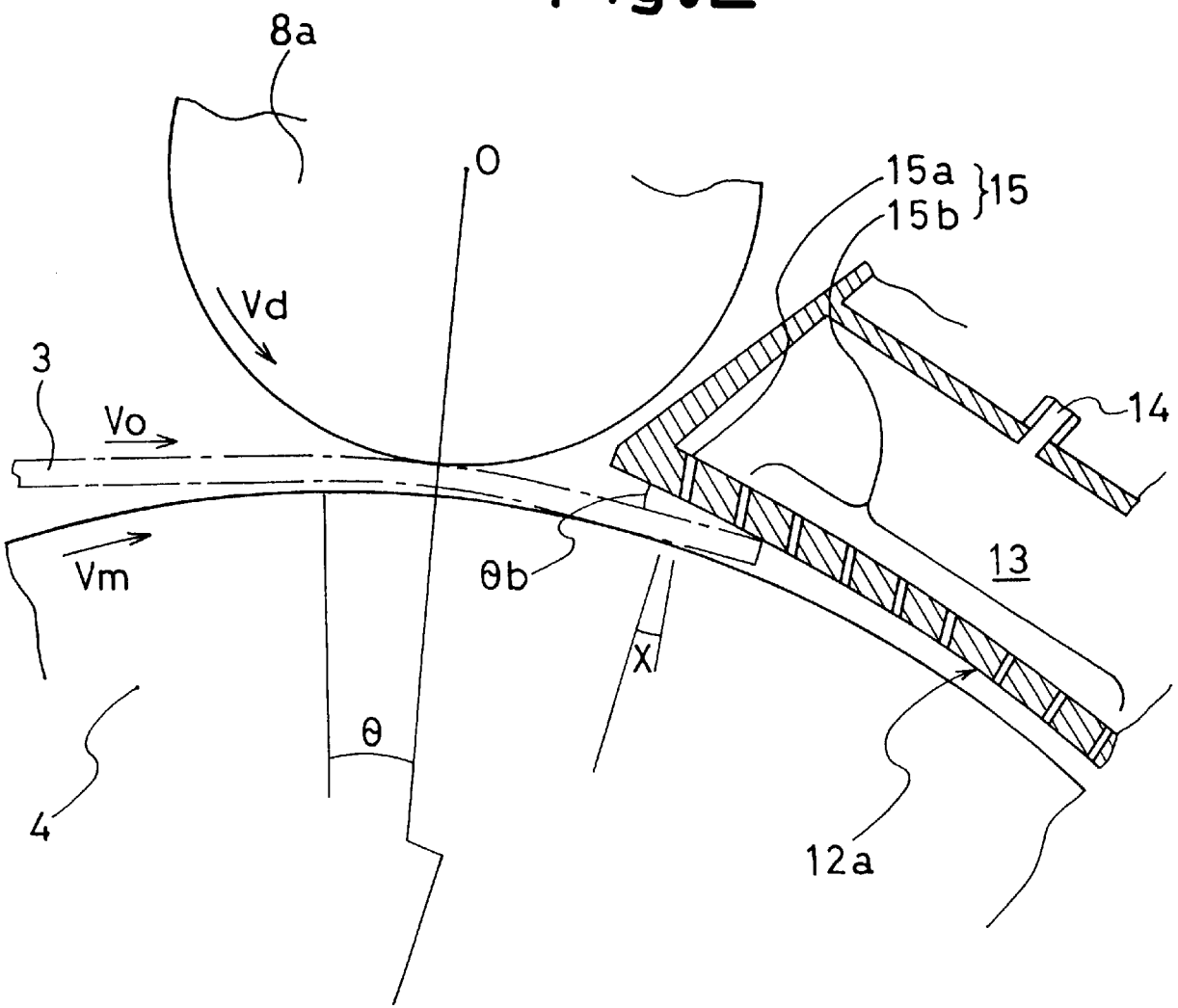
FIG. 2 is an enlarged view of an essential part of FIG. 1 showing the situation of start of winding.
Figure 3:
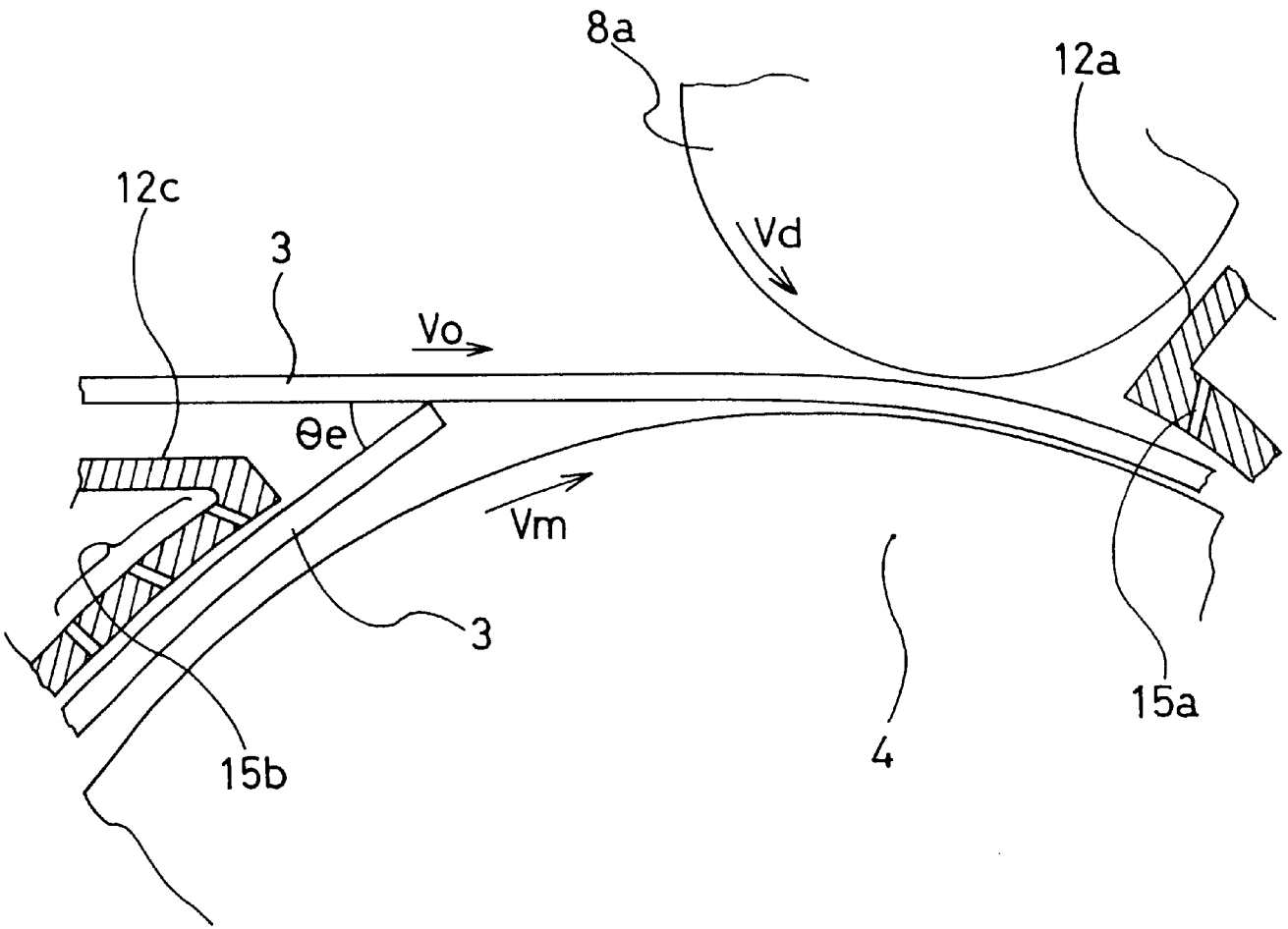
FIG. 3 is an enlarged view of the essential part of FIG. 1 showing the situation of winding immediately before winding a turn of a band steel plate.
Figure 8:
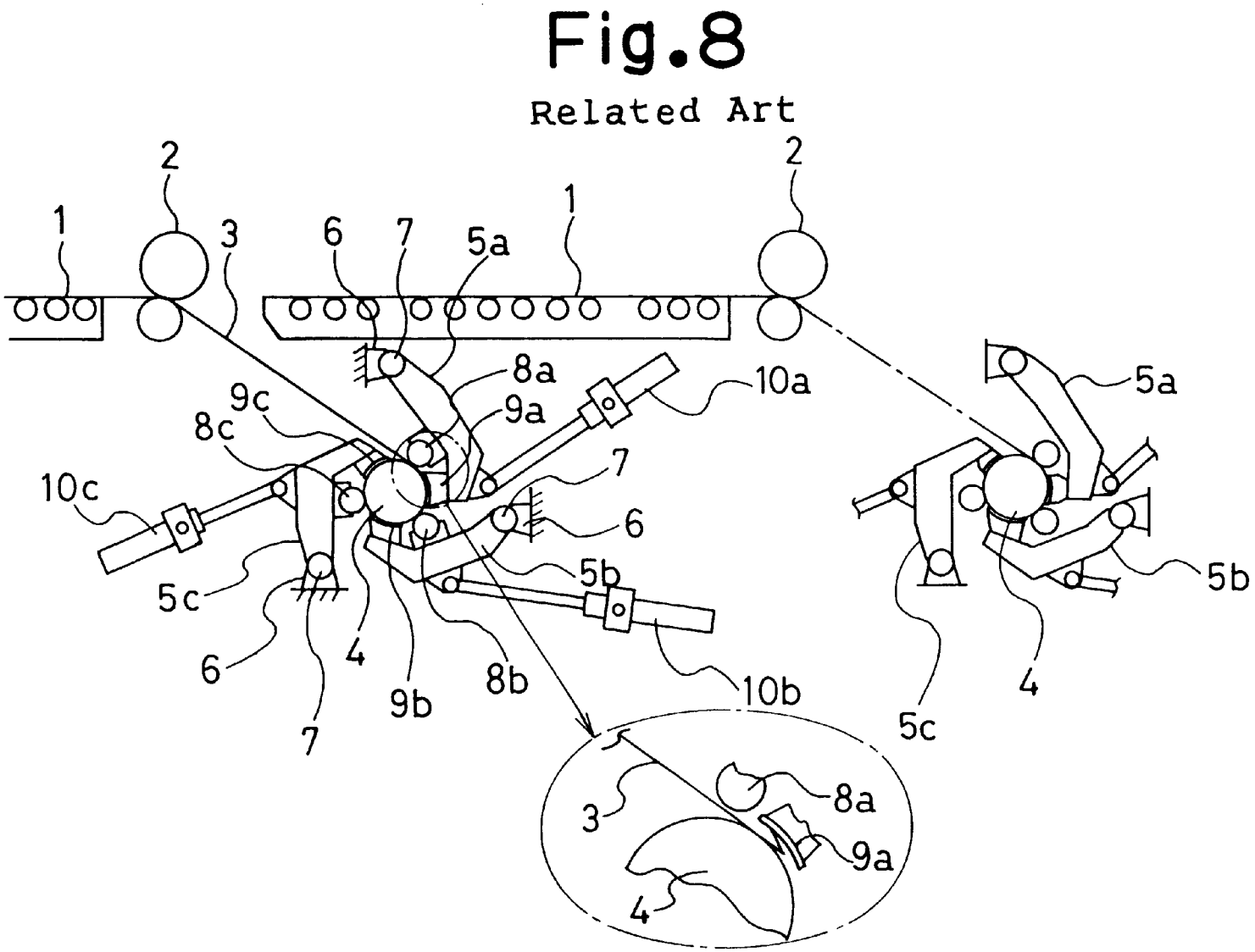
Fig.8 Related Art
FIG. 8 is a schematic side view of a conventional winding device.

FIG. 1 is a side view of a winding apparatus (downcoiler) showing a first embodiment of the invention. FIG. 2 is an enlarged view of an essential part of FIG. 1 showing the situation of start of winding. FIG. 3 is an enlarged view of the essential art of FIG. 1 showing the situation of winding immediately before winding a turn of a band steel plate. The same members as in FIG. 8 will be assigned the same reference numerals, and overlapping explanations will be omitted.

As shown in FIG. 1, a pair of guide plates 11*a* and 11*b* are disposed between a pinch roll (or a deflector roll) 2 disposed on a rolling equipment line and a winding drum (mandrel) 4 of a winding apparatus disposed below the rolling equipment line. Thus, a rolled band steel plate 3 is guided to a site between the winding drum 4 and a most upstream unit roll 8*a*, the site where the band steel plate 3 will be passed.

The winding drum 4 is located at a nearly tangential position relative to entry of the band steel plate 3. The unit roll 8*a* is located at a position offset from the winding drum 4 in a moving direction (to a downstream side) by an offset amount θ of within 15 degrees. The spacing between the winding drum 4 and the unit roll 8*a* ranges from 0.3 to 5 mm added to the thickness of the band steel plate 3. The peripheral velocity Vd of the unit roll 8*a*, like the peripheral velocity Vm of the winding drum 4, is not less than the entry velocity Vo of the band steel plate 3. The peripheral velocity ratio between them, Vd/Vo, is preferably about 1.1.

A curved surface guide 12*a*, paired with the unit roll 8*a* and supported on an arm-shaped frame 5*a*, is shaped like a box. As shown in FIG. 2, the interior of the curved surface guide 12*a* is a gas (air) chamber 13, which is supplied and charged with a pressurized gas (air) through a gas (air) supply port (pipe) 14 from a pressurized gas (air) supply source (not shown). In a guide surface of the curved surface guide 12*a*, a plurality of ejection nozzles 15 for the pressurized gas are opened and formed. The position of the ejection nozzles 15*a* in the foremost row (on the most upstream side) is not restricted, but is preferably such that the ejected pressurized gas will strike the band steel plate 3 before the band steel plate 3 collies with the curved surface guide 12*a*. The ejection angle of the ejection nozzles 15*a* in the foremost row is not restricted, but is preferably such that when only a row of the ejection nozzles 15*a* is provided, these ejection nozzles 15*a* are directed toward the center of the winding drum 4, or are inclined from the center of the winding drum 4 in the advancing direction of the band steel plate 3. For the other ejection nozzles 15*b*, the direction of ejection of the pressurized gas is not restricted. The ejection pressure of the pressurized gas in the gas chamber 13 may be 0.2 atmosphere or more as gauge pressure, and need not be a particularly high pressure. The diameter of the ejection nozzle 15*a* is 1 mm to 20 mm. The percentage of the hole area of the ejection nozzles with respect to a total area of the guide surface is 10% or less.

The spacing between the curved surface guide 12*a* and the winding drum 4 is from 0.3 mm to 10 mm added to the thickness of the band steel plate 3.

The curved surface guide 2*a* is provided apart from a succeeding unit roll 8*b* such that the front end of the curved surface guide 12*a* will be out of contact with the unit roll 8*b*. The unit roll 8*b* also rotates at a peripheral velocity greater than the entry velocity of the band steel plate 3. A curved surface guide 12*b* following the unit roll 8*b* is also constituted like the curved surface guide 12*a*. In a subsequent stage as well, a unit roll 8*c* and a curved surface guide 12*c* are constituted in the same manner as described above.

Immediately before the front end of the band steel plate 3 makes a turn about the winding drum 4, the guide plate 11*a* and the most downstream curved surface guide 12*c* become close to each other. The spacing between the guide plate 11*a* and the winding drum 4 is made at least the same as the spacing between the curved surface guide 12*c* and the winding drum 4 so that the front end of the band steel plate 3 will be able to pass through the gap between the guide plate 11*a* and the winding drum 4 and collide with a succeeding band steel plate 3 (immediately before being wound). As shown in FIG. 3, the arrangement of the winding drum 4 and the trailing end of the curved surface guide 12*c* has been determined so that the angle θe of collision will be 45 degrees or less. The front end of the band steel plate 3 that has collided with the succeeding band steel plate 3 is to enter between the band steel plate 3 and the winding drum 4 in a manner linked to the movement of the band steel plate 3.

The band steel plate 3 fed by the pinch roll 2 on the delivery side of the rolling equipment line is fed around an empty winding drum 4 under guidance of the guide plates 11*a*, 11*b*. The band steel plate 3 collides with the unit roll 8*a* rotating at a peripheral velocity greater than the entry velocity of the band steel plate 3. As a result, the band steel plate 3 changes its course to be directed toward the winding drum 4, and points toward the curved surface guide 12*a*. Then, the band steel plate 3 collides with the curved surface guide 12*a* at a small collision angle θb of 30 degrees or less. This is because the unit roll 8*a* is positioned at a site offset in the advancing direction (toward a downstream side) from the winding drum 4 by an offset amount θ of within 15 degrees. It has been experimentally confirmed that the collision angle θb of 30 degrees or less does not impede high speed winding of a thin band steel plate 3.

The band steel plate 3 that has collided with the curved surface guide 12*a* immediately bounces back under the pressure of the ejected pressurized gas and the reaction force of the band steel plate itself, and advances along the curved surface guide 12*a*. At this stage, the band steel plate 3 undergoes a force, with which to stick to the curved surface guide 12*a*, owing to the reaction force associated with the centrifugal force of the band steel plate 3 itself and its flexural rigidity. However, its contact with the curved surface guide 12*a* is inhibited by the pressure of the pressurized gas from the ejection nozzles 15*a*, 15*b* in the curved surface guide. Even if its contact occurred, its frictional force is so small that the band steel plate 3 smoothly enters between the winding drum 4 and the curved surface guide 12*a* without undergoing buckling. On this occasion, the gap between the winding drum 4 and the curved surface guide 12*a* may be relatively wide, and may measure about 0.5 mm to 20 mm. Since the winding drum 4 and the unit roll 8*a* rotate at the peripheral velocities Vm and Vd greater than the entry velocity of the band steel plate 3, they exert little force for hindering entry of the band steel plate 3. A gas flow between the winding drum 4 and the curved surface guide 12*a* preferably has a velocity not less than the velocity of the band steel plate 3.

The band steel plate 3 having the front end past the curved surface guide 12*a* collides with the unit roll 8*b*. Since the unit roll 8*b* also rotates at a peripheral velocity greater than the entry velocity of the band steel plate 3, it generates no force for pushing back the front end of the band steel plate 3, and allows the band steel plate 3 to approach the curved surface guide 12*b*. The curved surface guide 12*b*, like the curved surface guide 12*a*, has ejection nozzles 15*a*, 15*b*. Thus, the band steel plate 3 having collided with the curved surface guide 12*b* enters between the winding drum 4 and the curved surface guide 12*b* without undergoing buckling bending of its front end. At a subsequent stage, too, the band steel plate 3 enters between the winding drum 4 and the unit roll 8*c* and between the winding drum 4 and the curved surface guide 12*c*.

Immediately before the front end of the band steel plate 3 makes a turn about the winding drum 4, the guide plate 11*a* and the most downstream curved surface guide 12*c* become close to each other. It is advisable to make the spacing between the guide plate 11*a* and the winding drum 4 at least the same as the spacing between the curved surface guide 12*c* and the winding drum 4. In this case, the front end of the band steel plate 3 will be able to pass through the gap between the guide plate 11*a* and the winding drum 4 and collide with a succeeding band steel plate 3 (immediately before being wound). Experiments have shown that the angle θe of collision at this time should be set at 45 degrees or less. Given this angle of collision, the front end of the band steel plate 3 enters between the band steel plate 3 and the winding drum 4 in a manner linked to the movement of the band steel plate 3, without undergoing buckling.

The front end of the band steel plate 3 taken up between the band steel plate 3 and the winding drum 4 moves in a manner linked to the movement of the winding drum 4 rotating at a peripheral velocity greater than the entry velocity of the band steel plate 3. Then, the band steel plate 3 presses the unit rolls 8*a*, 8*b*, 8*c*, whereby a pressing force is exerted on the band steel plate 3. In this manner, the band steel plate 3 is pressed against the winding drum 4, and two to five turns of the band steel plate 3 are wound around the winding drum 4. Normally, the winding drum 4 rotates at a peripheral velocity greater than the peripheral velocity of the band steel plate 3. Thus, a tightening force during winding acts on the band steel plate 3, causing tension to the band steel plate 3. Thereafter, winding proceeds, with the tension of the band steel plate 3 under control.

In the foregoing apparatus, the number of the ejection nozzles is large per winder, thus requiring a large amount of air. Consequently, a high capacity pressure generator (e.g., compressor) becomes necessary, inducing a cost increase. A gas supply device proposed as a countermeasure will be described in a second embodiment of the invention.

Figure 4:
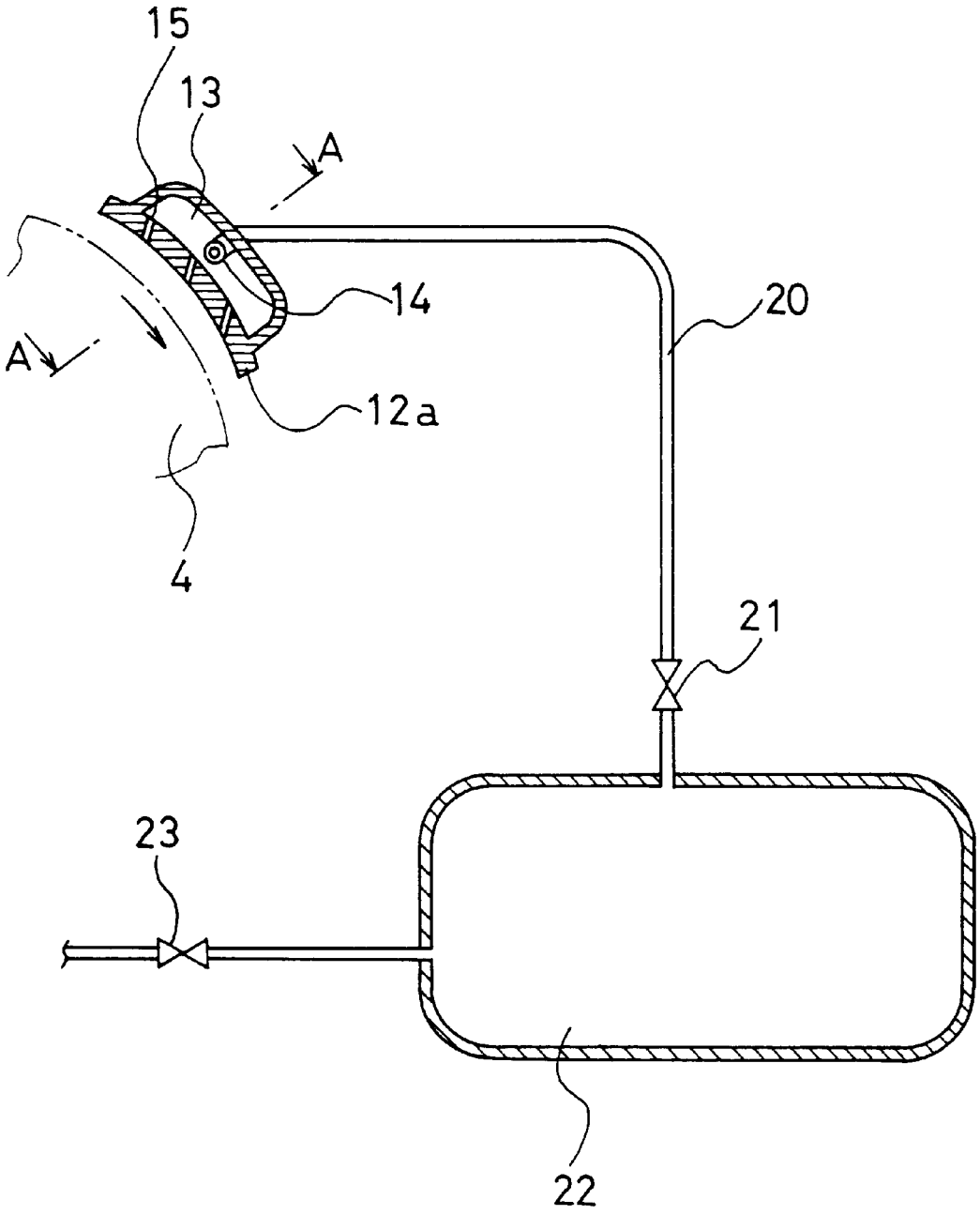
FIG. 4 is a conceptual view of a gas supply system showing a second embodiment of the present invention.
Figure 5:
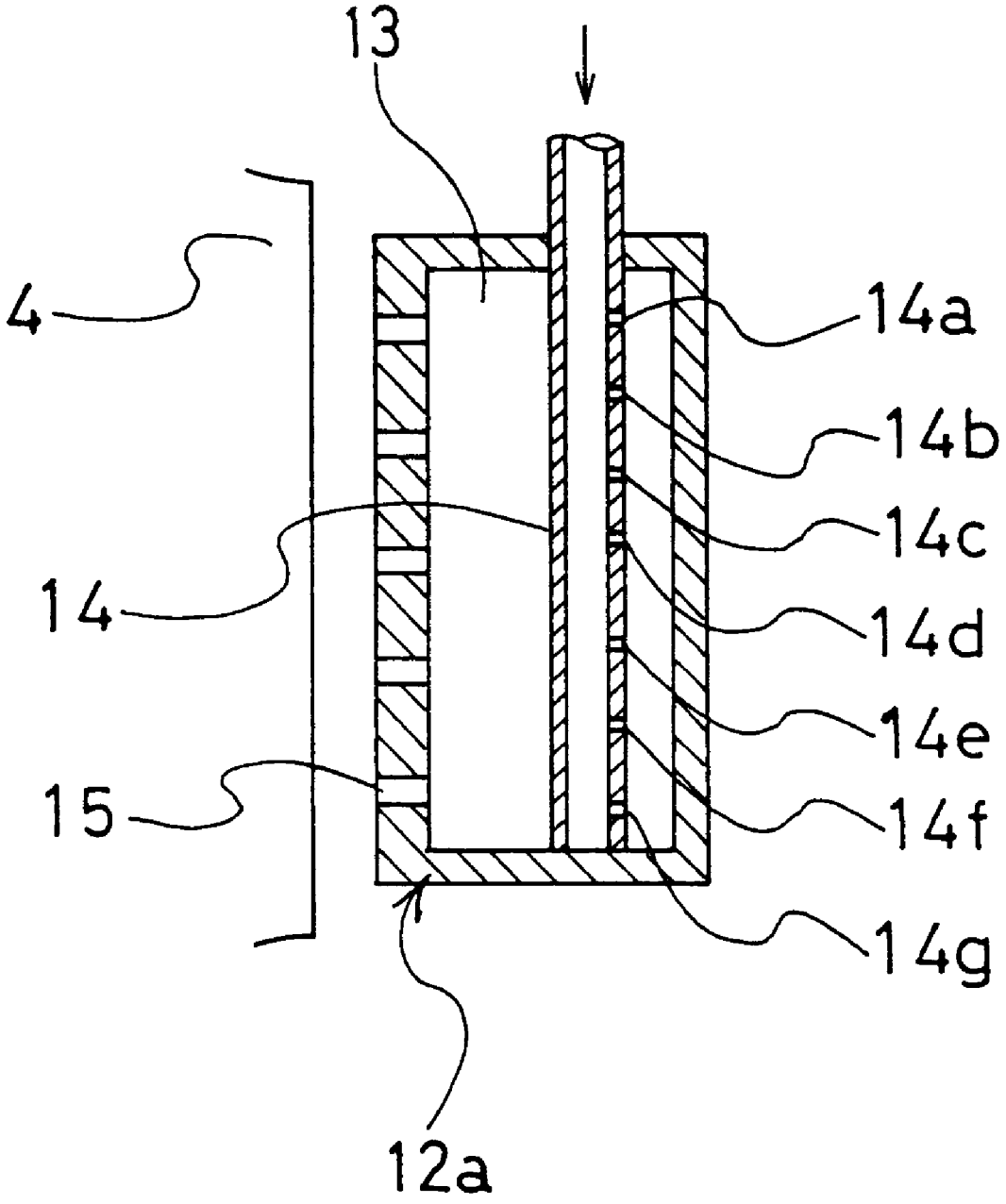
FIG. 5 is a sectional view taken along line A—A of FIG. 4.
Figure 6:
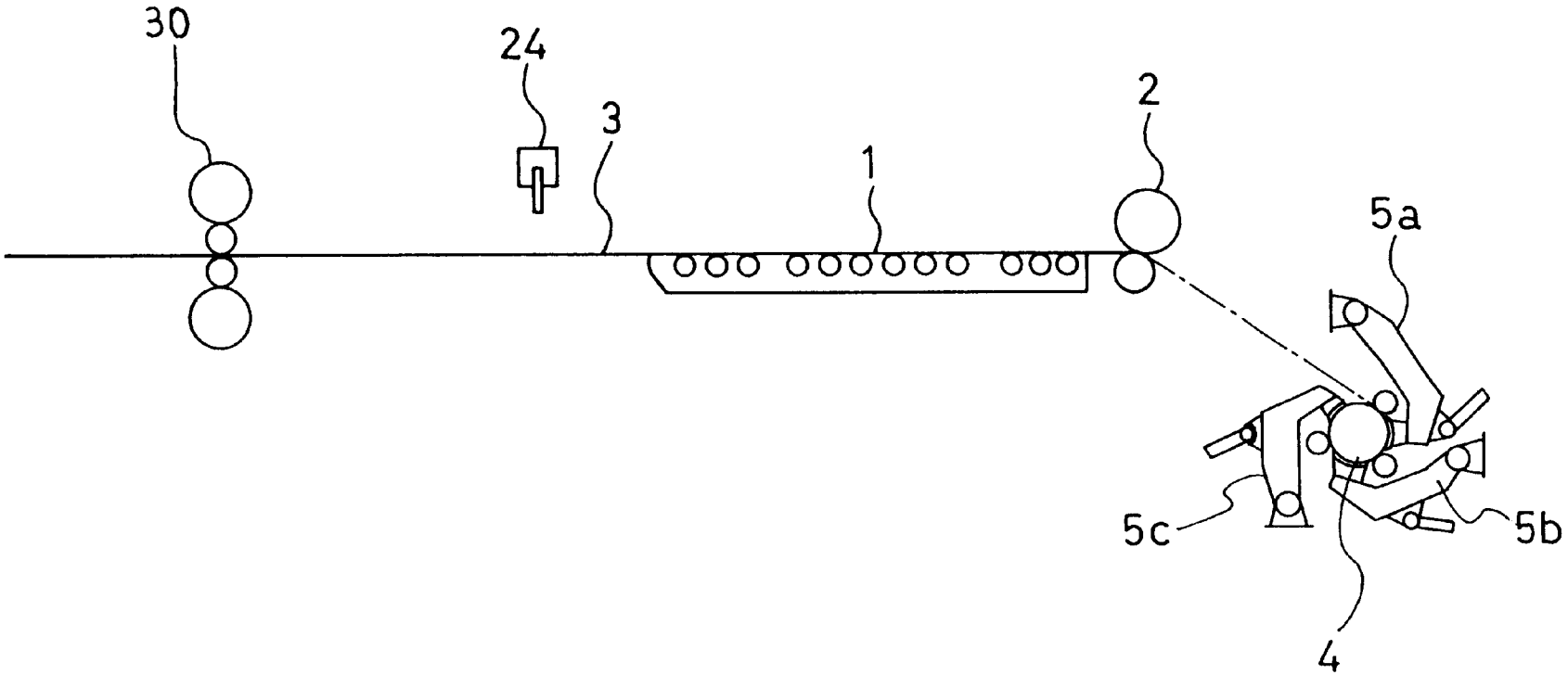
FIG. 6 is a conceptual view of a device for detecting timing of passage of a front end of the band steel plate.
Figure 7:
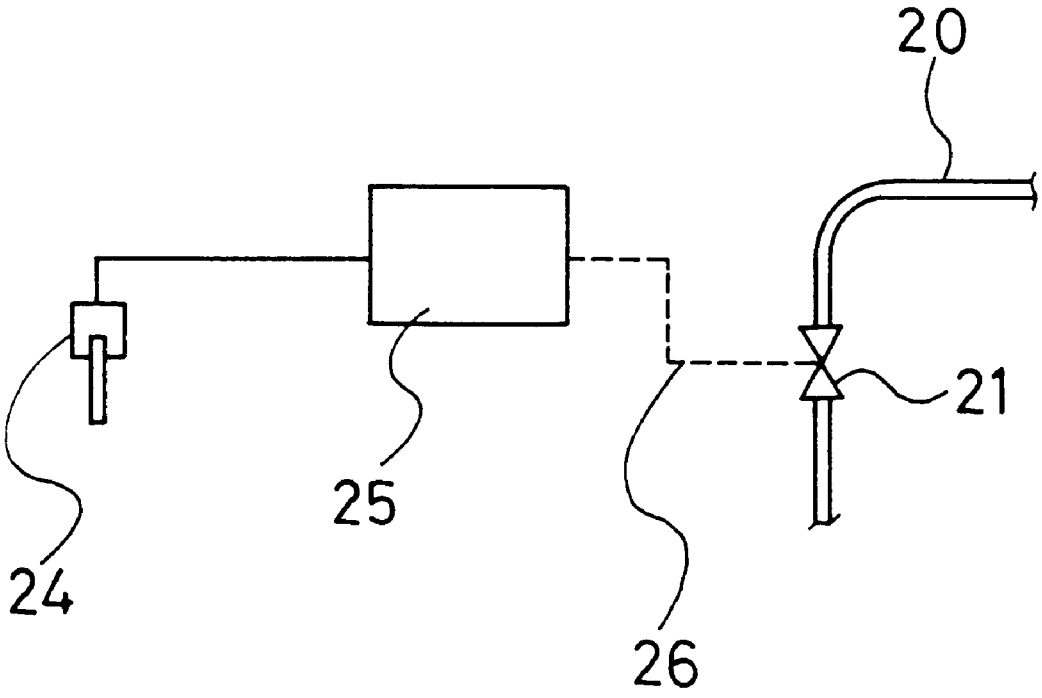
FIG. 7 is a conceptual view of signal processing in a controller.

FIG. 4 is a conceptual view of a gas supply system showing the second embodiment of the invention. FIG. 5 is a sectional view taken along line A—A of FIG. 4. FIG. 6 is a conceptual view of a device for detecting timing of passage of a front end of a band steel plate. FIG. 7 is a conceptual view of signal processing in a controller.

As illustrated, a steel plate front end detector 24 provided at a predetermined position detects that the front end of a band steel plate 3, which was rolled by a rolling roll 30, has traveled on a roller table 1 and come to the predetermined position. A detection signal from the steel plate front end detector 24 is entered into a controller (computing unit) 25. The controller 25 computes timing with which to open a gas ejection valve 21 interposed in a piping 20, from the velocity of the steel plate and the distance from the steel plate front end detector 24 to a winding drum 4. Using the results of computation, the controller 25 sends an "Open" signal to the gas ejection valve 21 via a signal cable 26. The controller 25 also computes a net ejection time, and issues a "Close" signal to the gas ejection valve 21. The piping 20 ties a gas chamber 13 of each of curved surface guides 12*a*, 12*b*, and 12*c* to a gas receiver (accumulator) 22.

Then, with the gas ejection valve 21 being closed, a valve 23 is opened to supply a pressurized gas from a pressure generator (e.g., compressor; not shown) into the gas receiver 22, making preparations for initiation of subsequent winding. The capacity of the gas receiver 22 can be determined by the amount of ejection and the duration of ejection.

The pressurized gas supplied by the piping 20 is guided into a gas supply port (pipe) 14 provided nearly throughout the width of a gas chamber 13, and is admitted into the gas chamber 13. If the sectional area of a plurality of ejection ports 14*a* to 14*g* is made smaller than the sectional area of the gas supply port (pipe) 14, the pressurized gas is emitted from the ejection ports 14*a* to 14*g* nearly uniform, making the pressure distribution inside the gas chamber 13 nearly constant.

For example, the transport speed of the band steel plate 3 was set to 800 m/min, the distance traveled by the band steel plate 3 from the steel plate front end detector 24 to the winding drum 4 was set to 8 m, the diameter of the piping 20 was set to 120 mm, and seven ejection ports 14*a* to 14*g* were provided in the gas supply port (pipe) 14, with the diameter of each ejection port being set to 20 mm. The length from the gas ejection valve 21 to the gas chamber 13 with a capacity of 0.15 $m^3$ was set to 5 m, the capacity of the gas receiver 22 at 1 $m^3$, and the accumulated pressure at 3 atmospheres. Twenty ejection nozzles 15 were provided in the gas chamber 13, with the diameter of each ejection nozzle being set to 10 mm.

The distance from the curved surface guides 12*a*, 12*b*, 12*c* to the gas receiver 22 is short. Thus, the pressurized gas can be ejected during the period from detection of the approach of the band steel plate 3 and issue of a gas ejection signal until arrival of the band steel plate 3 at the winding drum 4. When the distance traveled by the band steel plate 3 from the steel plate front end detector 24 to the winding drum 4 is 8 m, and the transport speed of the band steel plate 3 is 800 m/min, it takes 0.6 second for the band steel plate 3 to move from the steel plate front end detector 24 to the winding drum 4. This period of time is sufficient to cover the period from start of control until start of ejection from the ejection nozzles 15.

The duration of ejection of the pressurized gas is equal to a period of time required for winding several turns of the band steel plate 3 around the winding drum 4. This period is calculated as follows: Assume that the line velocity V is 800 m/min (=13.3 m/sec), and the diameter d of the winding drum 4 is 765 mm. The winding time $\tau$ (sec) is indicated by the following equation, and shown to be 0.18 sec per turn of the band steel plate 3 wound around the winding drum 4:

$\tau=\pi dn/V=0.18$ to 0.9 (sec) where n denotes the number of turns=1 to 5.

Thus, the net required gas ejection time of 1.0 to 2.0 seconds is enough, and if the gas is ejected only with required timing, the amount of the gas used need not be very large.

Even when the gas ejection time is short, a high capacity pressure generator is required, if the gas is directly supplied from the gas generation source. In the presence of a small capacity pressure generator (not shown) and the gas receiver 22, a large amount of the gas can be accumulated in the gas receiver 22 during a gas supply interruption period. Thus, a pressure generator of a large capacity is not required, and an operation can be carried out using an inexpensive device.

The gas may be ejected with truly necessary timing ensuring an ejection time of about 1 to 2 seconds, the period of time over which several turns of the band steel plate 3 are wound around the winding drum 4. Thus, the amount of the gas used is limited. To eject this amount at a time, a large capacity pressure generator is necessary. However, if the gas receiver 22 is provided, it is sufficient to accumulate air in the gas receiver 22 during a gas-unrequired period, a period during which no gas is required for winding, while the band steel plate 3 is being wound. Hence, an inexpensive pressure generator of a small capacity suffices.

When the gas supplied from the gas receiver 22 is fed to the gas chamber 13, the gas is released almost uniformly through the plurality of ejection ports 14*a* to 14*g* in a direction opposite to the ejection nozzles 15 provided in the gas chamber 13. Since the gas chamber 13 is minimized in capacity, the pressure inside it increases rapidly. The adequate pressure of the gas chamber 13 is about 0.05 $kgf/cm^2$ as gauge pressure. By adjusting the opening of the valve or the flow rate of the gas, therefore, an abrupt change in the gas pressure can be prevented. The ejection ports 14*a* to 14*g* for the gas are provided in the direction opposite to the ejection nozzles 15 provided in the gas chamber 13. Thus, the gas can be released almost uniformly through the ejection nozzles 15, so that an uneven pressure is not exerted on the band steel plate 3. Hence, the band steel plate 3 is wrapped around the winding drum 4 without undergoing a sideways movement.

In the present embodiment, the gas support port (pipe) 14 has been shown to be provided with the ejection ports 14*a* to 14*g*. The hole diameter of the ejection ports 14*a* to 14*g* may be progressively increased such that greater hole diameters are given to the ejection ports located more downstream. Alternatively, the sectional shape of the gas supply port (pipe) 14 may be made semicircular, with openings being provided in the semicircular gas supply port (pipe) 14 on a side opposite to the ejection nozzles 15.

In the above-described embodiments, the three unit rolls and the three curved surface guides have been provided, but four or more of the unit rolls and four or more of the curved surface guides may be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A band steel plate winding apparatus, comprising:

a winding drum for taking up a band steel plate;

a unit roll provided along a circumferential surface of the winding drum, said unit roll being movable between a winding drum surrounding position and a retreat position;

a curved surface guide provided adjacent said unit roll and along the circumferential surface of the winding drum; and ejection nozzles formed in a guide surface of each of the curved surface guides for ejecting a gaseous or liquid fluid toward the band steel plate, wherein a fluid supply pipe extends over nearly an entire width of an inside chamber of the curved surface guide, and the fluid supply pipe has openings in the inside chamber on a side opposite to the ejection nozzles of the guide surface.

2. The band steel plate winding apparatus of claim 1, further comprising:

a steel plate front end detector for detecting a front end of the band steel plate traveling on a roller table; and a controller for controlling fluid ejection timing based on a front end detection signal from the steel plate front end detector and permitting the ejection nozzles to eject the fluid with appropriate timing.

3. The band steel plate winding apparatus of claim 1, further comprising:

a pressure generating source for pressuring the fluid; and a fluid receiver for receiving the pressured fluid therein and provided between the ejection nozzles and the pressure generation source, wherein the pressurized fluid is supplied from the fluid receiver, and the pressure generating source pressurizes the fluid in the fluid receiver at a timing other than during wrapping of the band steel plate.

4. A band steel plate winding apparatus, comprising:

a winding drum for taking up a band steel plate;

a unit roll provided along a circumferential surface of the winding drum, said unit roll being movable between a winding drum surrounding position and a retreat position, a position of the unit roll relative to the winding drum at a time of entry of the band steel plate being downstream at an angle of about 15 degrees or less from a position of contact between the winding drum and the band steel plate; and a curved surface guide provided adjacent said unit roll and along the circumferential surface of the winding drum; and ejection means for ejecting a gaseous or liquid fluid at a high speed toward the band steel plate from the curved surface guide before the band steel plate collides with the curved surface guide, wherein a fluid supply pipe extends over nearly an entire width of an inside chamber of the curved surface guide, and the fluid supply pipe has openings in the inside chamber on a side opposite to the ejection nozzles of the guide surface.

5. The band steel plate winding apparatus of claim 4, wherein the fluid is ejected in a direction of a center line of the winding drum, or is ejected with a slope in a direction of advance of the band steel plate.

6. The band steel plate winding apparatus of claim 4, further comprising:

a steel plate front end detector for detecting a front end of the band steel plate traveling on a roller table; and a controller for controlling a fluid ejection timing based on a front end detection signal from the steel plate front end detector and permitting the ejection means to eject the fluid with appropriate timing.

7. The band steel plate winding apparatus of claim 4, further including:

a pressure generating source for pressurizing the fluid; and a fluid receiver for receiving the pressurized fluid therein and provided between the ejection means and a pressure generating source, wherein the pressurized fluid is supplied from the fluid receiver, and the pressure generating source pressurized the fluid in the fluid receiver at a timing other than during wrapping of the band steel plate.

* * * * *